US008128461B1

(12) United States Patent
O'Moore et al.

(10) Patent No.: US 8,128,461 B1
(45) Date of Patent: Mar. 6, 2012

(54) CHEMICAL MECHANICAL POLISHING WITH MULTI-ZONE SLURRY DELIVERY

(75) Inventors: Fergal O'Moore, Los Gatos, CA (US); Steve Schultz, Gilbert, AZ (US)

(73) Assignee: Novellus Systems, Inc., San Jose, CA (US)

( * ) Notice: Subject to any disclaimer, the term of this patent is extended or adjusted under 35 U.S.C. 154(b) by 843 days.

(21) Appl. No.: 12/140,035

(22) Filed: Jun. 16, 2008

(51) Int. Cl.
*B24B 1/00* (2006.01)

(52) U.S. Cl. ..... 451/41; 451/60; 451/285; 451/287; 451/446

(58) Field of Classification Search ..... 451/36, 451/41, 57, 59, 60, 285, 287, 446
See application file for complete search history.

(56) References Cited

U.S. PATENT DOCUMENTS

| | | | | |
|---|---|---|---|---|
| 5,658,185 | A * | 8/1997 | Morgan et al. | 451/36 |
| 5,816,900 | A * | 10/1998 | Nagahara et al. | 451/285 |
| 6,494,765 | B2 * | 12/2002 | Gitis et al. | 451/5 |
| 6,572,445 | B2 * | 6/2003 | Laursen | 451/10 |
| 6,705,928 | B1 * | 3/2004 | Barns | 451/60 |
| 6,790,128 | B1 * | 9/2004 | Taylor et al. | 451/41 |
| 6,918,824 | B2 | 7/2005 | Marquardt et al. | |
| 6,951,597 | B2 * | 10/2005 | Korovin | 156/345.13 |
| 7,018,273 | B1 | 3/2006 | Kiermasz et al. | |
| 7,632,170 | B2 * | 12/2009 | O'Moore et al. | 451/65 |
| 2002/0019197 | A1 * | 2/2002 | Sharples et al. | 451/41 |
| 2002/0072307 | A1 * | 6/2002 | Fruitman et al. | 451/36 |
| 2002/0173232 | A1 * | 11/2002 | Laursen | 451/8 |
| 2002/0173249 | A1 * | 11/2002 | Dyer | 451/60 |
| 2003/0092363 | A1 * | 5/2003 | Laursen et al. | 451/41 |
| 2003/0134576 | A1 * | 7/2003 | Chadda et al. | 451/41 |
| 2003/0153245 | A1 * | 8/2003 | Talieh et al. | 451/8 |
| 2003/0153246 | A1 | 8/2003 | Desai et al. | |
| 2004/0063387 | A1 * | 4/2004 | Barns | 451/60 |
| 2005/0070214 | A1 | 3/2005 | Marquardt et al. | |
| 2006/0063469 | A1 * | 3/2006 | Talieh et al. | 451/5 |

OTHER PUBLICATIONS

European Patent Office, International Searching Authority "International Search Report," mailed Oct. 14, 2009, for International Application No. PCT/US2009/047376.

* cited by examiner

*Primary Examiner* — Eileen P. Morgan

(57) ABSTRACT

Chemical-mechanical polishing or planarization (CMP) is enhanced with multi-zone slurry delivery. A polishing pad is provided that contacts with the work piece, and a multi-zone platen is displaced proximate to the polishing pad to facilitate slurry delivery. The platen includes multiple fluid distribution layers that each include a fluid-distributing channel extending from a fluid source to a distribution point on layer. The distribution points on each of the fluid distribution layers correspond to different locations on the polishing surface to thereby create multiple fluid-delivery zones on the pad.

20 Claims, 6 Drawing Sheets

CHEMICAL MECHANICAL POLISHING WITH MULTI-ZONE SLURRY DELIVERY

TECHNICAL FIELD

This document generally relates to chemical-mechanical polishing/planarization (CMP). More particularly, this document relates to CMP devices and techniques that include multi-zone delivery of slurry or other fluid.

BACKGROUND

Chemical-mechanical polishing (CMP) is a process of removing material from a semiconductor wafer or other work piece to create a smooth planar surface. Typically, a combination of chemical reaction and mechanical force is used to remove material from a front surface of the work piece to thereby create the planar surface. In a conventional CMP assembly, the work piece is secured in a carrier head such that the surface to be polished is exposed. The exposed surface of the work piece is then held against a polishing pad or other surface that is generally mounted to a rigid platen. Typically, a polishing slurry is introduced onto the polishing surface of the pad, and the work piece and/or polishing pad are moved in relation to each other in a linear, circular, orbital or other fashion to polish or planarize the surface of the work piece as desired.

Frequently, slurry is supplied to the polishing surface through one or more holes in the polishing pad. These holes typically receive fluid via a common delivery line from a fluid supply source. In many implementations, a manifold or similar structure equalizes fluid resistances for the various paths flowing to the different holes. While the manifold structures found in many implementations have been beneficial for many purposes, the complex design of such structures can create certain limitations and other issues. In particular, the number of holes that can be supported by any particular manifold can be relatively limited, thereby creating issues in distributing slurry and/or creating even flow across the surface of the polishing pad.

It is therefore desirable to create polishing structures and techniques that are able to improve the uniformity of slurry delivery across the surface of the pad. Furthermore, other desirable features and characteristics will become apparent from the subsequent detailed description and the appended claims, taken in conjunction with the accompanying drawings and the foregoing technical field and background.

BRIEF SUMMARY

In various embodiments, chemical-mechanical polishing or planarization (CMP) of a work piece is enhanced with multi-zone slurry delivery. A polishing pad is provided that contacts with the work piece, and a multi-zone platen is displaced proximate to the polishing pad to facilitate slurry delivery. The platen includes multiple fluid distribution layers that each include a fluid-distributing channel extending from a fluid source to a distribution point on layer. The distribution points on each of the fluid distribution layers correspond to different locations on the polishing surface to thereby create multiple fluid-delivery zones on the pad.

In other embodiments, a platen for use in chemical-mechanical polishing of a work piece is provided. The platen comprises a first fluid distribution layer comprising a first channel radially extending from a first fluid source to a first distribution point and a second fluid distribution layer proximate the first fluid distribution layer and comprising a second channel radially extending from a second fluid source to a second fluid distribution point, wherein the second fluid distribution layer further comprises a hole corresponding to the first distribution point in the first fluid distribution layer. An expansion layer is located proximate the second fluid distribution layer, wherein the expansion layer comprises a first channel hole corresponding to the hole in the second fluid distribution layer and a second channel hole corresponding to the second fluid distribution point.

In still other embodiments, a method of chemical-mechanical polishing of a work piece using a platen having a plurality of slurry delivery zones is provided. The method comprises initiating chemical-mechanical polishing of the work piece to thereby provide slurry to the work piece via each of the plurality of slurry delivery zones, and, for each of the plurality of slurry delivery zones, adjusting an amount of slurry provided via the slurry delivery zone during chemical-mechanical polishing of the work piece.

BRIEF DESCRIPTION OF THE DRAWINGS

Various embodiments will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

According to various exemplary embodiments, new structures and techniques for chemical mechanical polishing/planarization are provided that allow for a number of slurry-delivery "zones" to be created on the polishing pad. Slurry fluid can be separately provided and controlled for each zone to reduce variations in slurry flow across the pad, or to deliver different flow rates to different zones during polishing. In various embodiments, the multiple slurry delivery zones are implemented with a multi-layer platen assembly that separately distributes slurry from different supply lines to the various zones. Such structures may be able to provide better slurry coverage across the surface of the pad or work piece than prior structures. Moreover, by separately providing and controlling slurry delivery to the various zones of the platen or pad, improved uniformity in slurry delivery rates can be established, and/or the availability of slurry distributed across the pad can be tuned across the surface of the pad to better control the radial sheer realized at various points of the pad/work piece interface.

A number of terms are clarified at the outset. For example, the terms "polishing" and "planarization", although occasionally having different connotations, are often used interchangeably by those skilled in the art. For ease of description such common usage will be followed and the term "CMP" may equivalently convey either "chemical mechanical polishing" or "chemical mechanical planarization." The terms "polish" and "planarize" will also be used interchangeably herein. Further, the phrases "chemical mechanical polishing/planarization" and CMP are intended to broadly encompass equivalent techniques, such as electrochemical mechanical polishing (ECMP), that may have similar capabilities and/or requirements in terms of uniform removal of material from a work piece. The term "fluid" is intended to encompass any liquid, gas or other substance that is capable of flowing through a passageway. Examples of fluids include slurry, chemical solvents, vapors, mists, air or other atmospheric venting, mixing fluid, pressure or vacuum gases, or any other materials in any liquid, vaporous and/or other form. Moreover, the term "exemplary" is intended in the context of an example, which may or may not be intended as a model. That is, an "exemplary" embodiment is merely intended as one example of an embodiment that may have any number of alternate and/or additional embodiments or features that may differ from those described herein.

Figure 1:
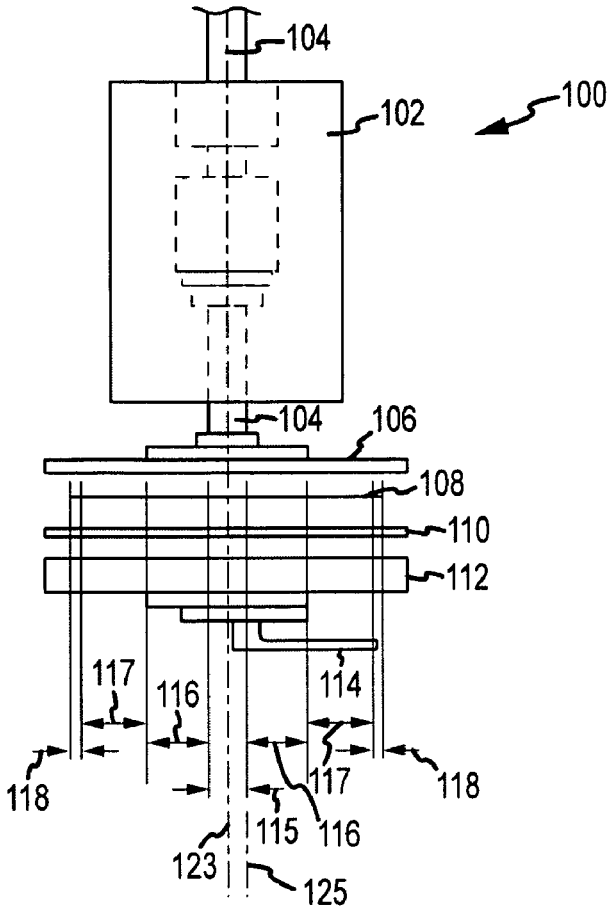
FIG. 1 is a cross-sectional view of an exemplary CMP apparatus with multiple slurry delivery zones.

Turning now to the drawing figures, FIG. 1 shows an exemplary CMP apparatus 100 that includes a spindle assembly 102 coupled to a carrier head 106 via a shaft 104. Carrier head 106 is designed to accept a wafer or other work piece 108, and to support the work piece 108 against a polishing pad 110 or other surface during planarization. In various embodiments, shaft 104 extends and retracts in a lateral manner (e.g., in the vertical direction as illustrated in FIG. 1) to apply pressure to a back side of the work piece 108, thereby forcing work piece 108 against polishing pad 110. In equivalent embodiments, work piece 108 is maintained in an approximately constant position, and pad 110 is displaced by a motor/shaft arrangement or other structure to thereby create pressure between pad 110 and a front surface work piece 108. Typically, a motor or other structure within spindle assembly 102 rotates shaft 104 and carrier head 106 to create rotational movement between work piece 108 and polishing pad 110. In various embodiments, spindle assembly 102 also creates dithering, oscillatory or other movement of work piece 108 with respect to polishing pad 110 as appropriate.

A platen assembly 112 mechanically supports polishing pad 110, and in many embodiments supplies slurry to the polishing interface between pad 110 and work piece 108. Platen 112 may optionally contain a multi-layered fluid delivery system with slurry supply and/or exhaust holes or passageways provided to deliver and/or remove slurry to and/or from the top surface of polishing pad 110. During a conventional polishing operation, pad 110 is moved in a rotational and/or orbital motion about a platen axis 125 while the carrier head 20 simultaneously rotates the wafer 21 about the carrier head axis 123. In a typical CMP process, the carrier head axis 123 is offset from the platen axis 125 by a distance typically referred to as the upper-to-lower head offset. Moreover, in various embodiments, the entire platen assembly 112 may orbit about the carrier head axis 123 or another point as appropriate. This orbiting motion may be provided by an arm 114 or other structure coupling platen assembly 112 to a motor or the like.

Figure 2:
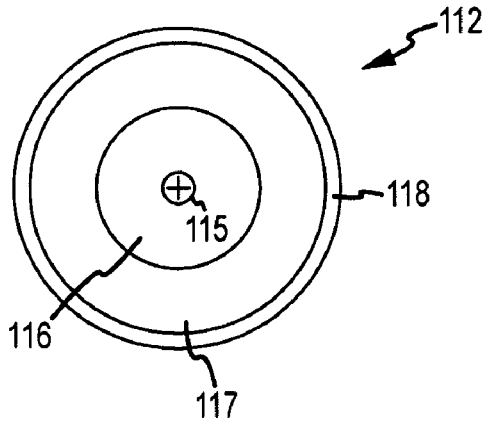
FIG. 2 is a top view of an exemplary platen assembly for a CMP apparatus showing multiple slurry delivery zones.

During the polishing process, slurry is delivered through platen 112 to one or more polishing zones 115, 116, 117, 118 as described more fully below. FIG. 1 shows various exemplary zones 115-118 in a side view, whereas FIG. 2 shows the same exemplary zones 115-118 in a top-down view. In the example shown in FIGS. 1 and 2, four exemplary zones 115, 116, 117 and 118 are shown as concentric annular regions. In other embodiments, however, any number of zones 115-118 may be provided, with each zone taking any shape or size with respect to the other zones. In certain embodiments, for example, it may be beneficial to provide a number of relatively narrow zones that correspond to the periphery of the work piece 108, as this will provide additional control over edge conditions during planarization. Slurry delivery zones 115-118 may be correlated to carrier pressure zones, for example, or designed to alleviate polish non-uniformities due to edge burn and/or other effects. Equivalent embodiments to those shown in FIGS. 1-2 may therefore provide any number of independently-controllable slurry delivery zones 115-118, which may be shaped in any concentric or non-concentric manner and sized according to any regular or irregular scheme as desired.

Slurry may be exhausted from the surface of polishing pad 108 in any manner. In various embodiments, the polishing surface of pad 110 provides a set of grooves or other topographical features to distribute slurry fluid across the surface of the pad 110 during planarization. These features, as well as the kinematics of the relative motion between work piece 108 and pad 110, can effectively direct the movement of slurry particles during polishing in any desired manner. Exhaust holes or other passageways may also be provided in pad 110 and/or platen 112 for recovery of spent slurry. One example of a fluid distribution system that provides relatively uniform distribution of fluid across the surface of pad 110, as well as fluid exhaust, is described in U.S. Pat. No. 6,918,824, although any other fluid distribution and/or exhaust techniques may be equivalently applied in other embodiments.

In operation of CMP apparatus 100, slurry can be independently controlled for delivery to each of the zones to thereby allow for substantially consistent slurry flow across the interface between pad 110 and work piece 108, or to adjust the flow of slurry in one or more zones 115-118 with respect to slurry flow in any other zone. For example, slurry flow may be controlled using a digital microprocessor, microcontroller or the like to independently adjust the rates of slurry flow to one or more zones 115-118 as desired. Slurry flow may be controlled in any manner. In various embodiments, a common slurry delivery line could pass through an independent valve, orifice or other type of fixed or variable restrictor for each zone, for example. In other embodiments, multiple slurry delivery lines could be provided for two or more zones, with each delivery line having its own flow controller. Various techniques and structures for implementing multi-zone slurry delivery are described more fully below.

Figure 3:
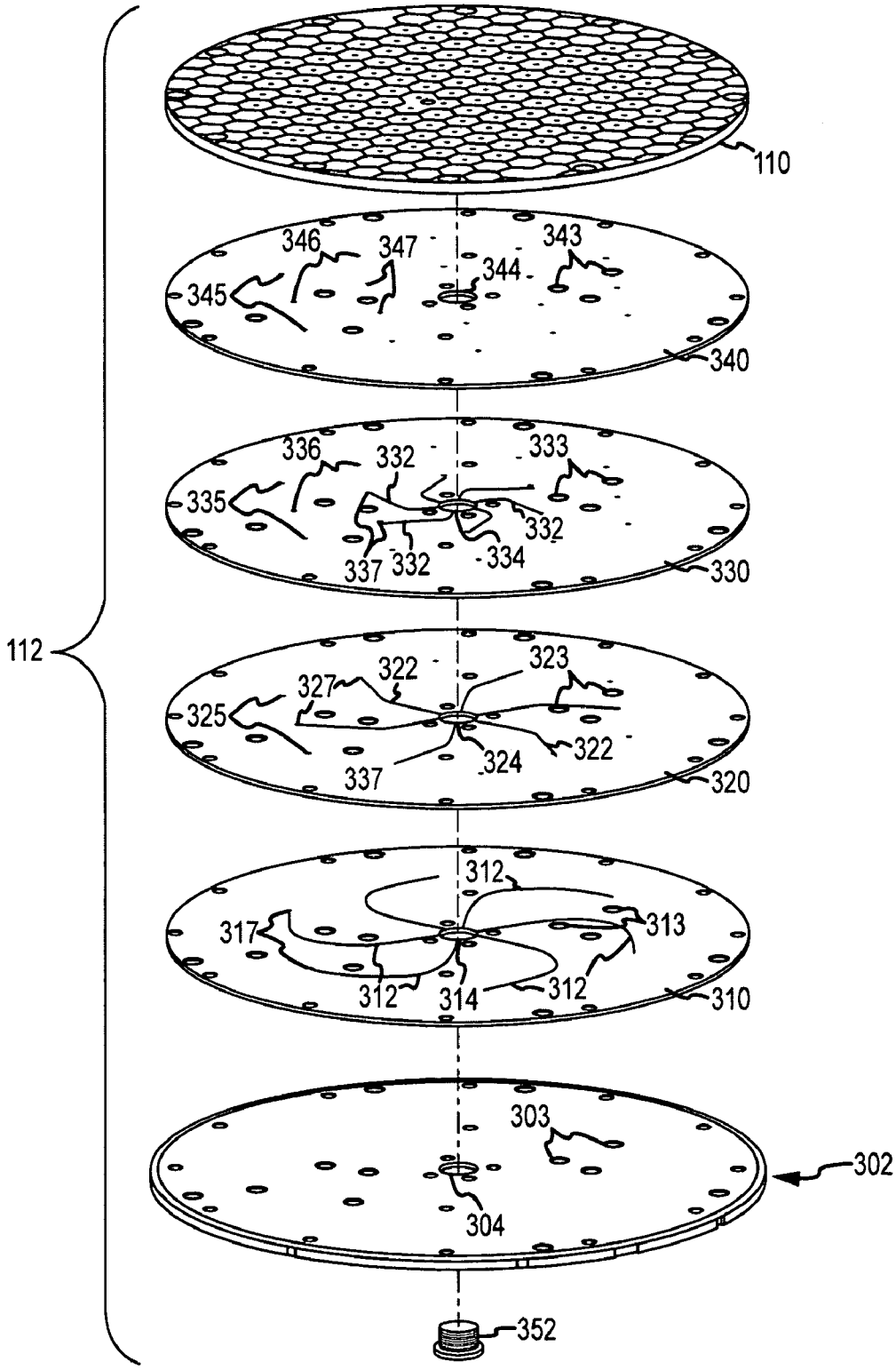
FIG. 3 is an exploded perspective view of an exemplary platen assembly for a CMP apparatus providing multiple slurry delivery zones.

In the exemplary embodiment shown in FIG. 3, for example, one type of stacked, multi-layer platen assembly 112 suitably includes a base or support layer 302, an appropriate number of fluid distribution layers 310, 320, 330, and an expansion layer 340. The stacked assembly 112 is provided in proximity to the polishing pad 110 to distribute slurry or other fluid thereto. In various embodiments, platen 112 also includes a central plug 352, as described more fully below.

Base or support layer 302 is any structure capable of supporting the fluid distribution layers 310, 320, 330 as appropriate. Layer 302 as illustrated in FIG. 3 contains any number of holes 303 for accommodating slurry exhaust as well as placement of eddy probes, endpoint detection probes and/or the like. Layer 302 also includes a central hole 304 that can accommodate plug 352. In various embodiments, base layer 302 is not present, and the first layer in the stacked platen assembly 112 includes fluid distribution channels or other structures as appropriate.

Each fluid distribution layer 310, 320, 330 contains appropriate fluid distribution channels 312, 322, 332 to distribute slurry or other fluids from a fluid source (e.g. plug 352) to one or more fluid distribution points 317, 327, 337 (respectively). Channels 312, 322, 332 represent any sort of grooves, ducts or other passages in fluid distribution layers 310, 320, 330 that are capable of conducting slurry or other fluid. Although FIG. 3 shows the various channels being formed in the relative "top" surfaces of layers 310, 320, 330, equivalent embodiments may include grooves or other channels in the opposite sides of the layer, or even ducts formed in the interior of the layer. Moreover, channels formed in any fluid distribution layer 310, 320, 330 may cooperate with fluid sources, channels and/or any other structures formed in adjoining layers to conduct fluid toward a desired polishing zone in any manner.

Fluid distribution channels 310, 320, 330 may take any shape or dimension. In the embodiment shown in FIG. 3, fluid distribution points 317, 327, 337 simply represent endpoints of the distribution channels 312, 322, 332. In many embodiments, these endpoints can be the primary point for distributing slurry or other fluid away from the fluid distribution layer and toward polishing pad 110. Each fluid distribution layer 310, 320, 330 also contains any number of holes or other passages to accommodate flow from the fluid distribution points 317, 327, 337 of lower layers toward polishing pad 110, and also to accommodate fluid exhaust, probe placement and/or other factors as appropriate. Layer 320, for example, is shown with holes 325 corresponding to distribution points 317 on layer 310. Layer 330 is similarly shown with holes 335 corresponding to distribution points 317 on layer 310, and also holes 336 corresponding to distribution points 327 on layer 320. Moreover, each layer 310, 320, 330 generally includes a hole 314, 324, 334 (respectively) at a central location or other appropriate position to accommodate fluid source 352, as described more fully below.

Each fluid distribution layer 310, 320, 330 shown in FIG. 3 corresponds to one or more delivery zones 115-118, such as those shown in FIGS. 1-2. Layer 310, for example, contains fluid passages 312 to distribution points 317 that generally extend further away from the fluid source 314 and closer the periphery of platen 112. Layer 330, in contrast, contains fluid passages 332 that extend to distribution points 337 located closer to the central fluid source 344 and further away from the periphery of platen 112. Layer 320 contains fluid passages 322 that extend to distribution points 327 located roughly midway between passages 317 and 337 in terms of radial distance on platen 112 from fluid source 352, which in this example is located in the approximate center of platen 112. Fluid provided to each layer 310, 320, 330 of platen 112, then, is ultimately provided to an associated zone on polishing pad 110. The amount of fluid provided to the relative periphery of pad 110, for example, can be increased by increasing the fluid flow provided to layer 310. Similarly, the amount of fluid provided to layer 310 can be reduced to decrease the amount of fluid present on the relative periphery of polishing pad 110.

Expansion layer 340 similarly contains any number of holes or other channels to accommodate fluid flow from each of the lower fluid distribution layers 310, 320, 330. Layer 340 may also contain additional holes or other passages 343 to accommodate probe placement, fluid exhaust and/or other features as appropriate. Although not shown in FIG. 3, expansion layer 340 may also contain distribution expansion channels, such as those described below in conjunction with FIG. 4, to further improve the distribution and spreading of slurry or other fluid across the surface of pad 110.

In operation, then, fluid provided to each layer 310, 320, 330 is ultimately distributed to a particular zone of polishing pad 110 as appropriate. Fluid provided to layer 310, for example, is distributed radially outward from source 314 toward distribution points 317 by channels 312. Fluid then passes from points 317 through holes 325 in layer 320, holes 335 in layer 330, and holes 345 in layer 340 to ultimately arrive at polishing pad 110. Fluid provided to layer 320 is similarly provided radially outward from source 324 toward distribution points 327 by channels 322; this fluid is then conducted toward pad 110 by holes 336 in layer 330 and holes 346 in layer 340. Channels 332 in layer 330 similarly conduct fluid provided to layer 330 at source 334 to distribution points 337 by channels 332, and holes 347 in layer 340 conduct the fluid toward pad 110. Fluid is exhausted from pad 110 through a channel formed by holes 303, 313, 323, 333 and 343, as appropriate.

Although the exemplary embodiment of FIG. 3 shows three fluid distribution layers 310, 320, 330 corresponding to three zones (e.g., zones 315-318 in FIG. 1) on polishing pad 110, any number of zones can be provided through the addition or removal of one or more fluid distribution layers. Moreover, the numbers and locations of fluid distribution points on one or more layers may be adjusted upwardly or downwardly in other embodiments, and indeed such numbers and shapes may vary between multiple layers of a single embodiment. Numerous changes may therefore be made to the general structure shown in FIG. 3 and described herein without departing from the general concept of multi-zone delivery.

Figure 4:
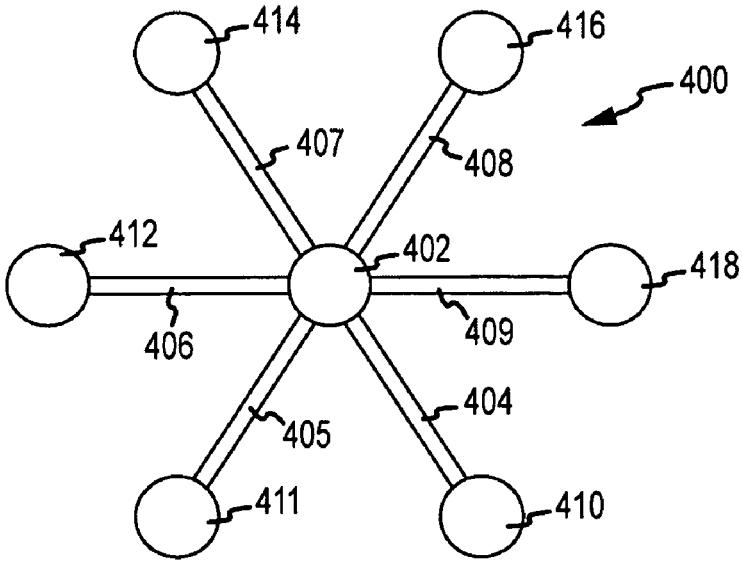
FIG. 4 is a top view of an exemplary expansion structure for slurry delivery.

Fluid distribution may be further improved through the inclusion of additional distribution features in expansion layer 340. With reference now to FIG. 4, an expansion structure 400 suitably includes any number of expansion channels 404, 405, 406, 407, 408, 409 that each extend from a central point 402 toward a distribution point 410, 411, 412, 413, 414, 415, 416, 417, 418 (respectively). In various embodiments, the central point 402 corresponds to one or more channel holes (e.g., holes 345, 346, 347 in FIG. 3) that receive fluid from one or more of the underlying fluid distribution layers 310, 320, 330. Each channel 404-409, then, suitably conducts fluid received through the channel hole 345-347 to cover a larger surface of polishing pad 110 (FIGS. 1 and 3). Distribution points 410-418 need not be enlarged areas as shown in FIG. 4; to the contrary, these points 410-418 may simply represent the endpoints of channels 404-409 as appropriate. Note that structures similar to structure 400 may be alternately provided on each fluid distribution layer 310, 320, 330, although this would typically require additional channel holes 345-347 to be formed to achieve equivalent fluid distribution. Also note that the overall layout of structure 400 may be radically different in other embodiments; rather than six expansion channels 404-409, for example, alternate embodiments may have as few as one or as many as twenty or more channels emanating from any central point 402. The various channels 404-409 need not be equally spaced from each other, as shown in FIG. 4, and need not be of the same length. To that end, the "central point" 402 need not necessarily be located in the geometric "center" of the structure 400, but may be located in any convenient point as determined by the particular embodiment. Also note that the expansion channels 404-409 need not be straight, as shown in FIG. 4, but may be curved or otherwise shaped to allow fluid distribution across the surface of pad 110. Fluid could be routed around holes 343-344, for example, or otherwise transmitted to areas of pad 110 that would be otherwise difficult to reach with underlying channel holes. The exemplary structure 400 shown in FIG. 4 may therefore be configured in many different ways to implement a wide array of equivalent embodiments.

Figure 5:
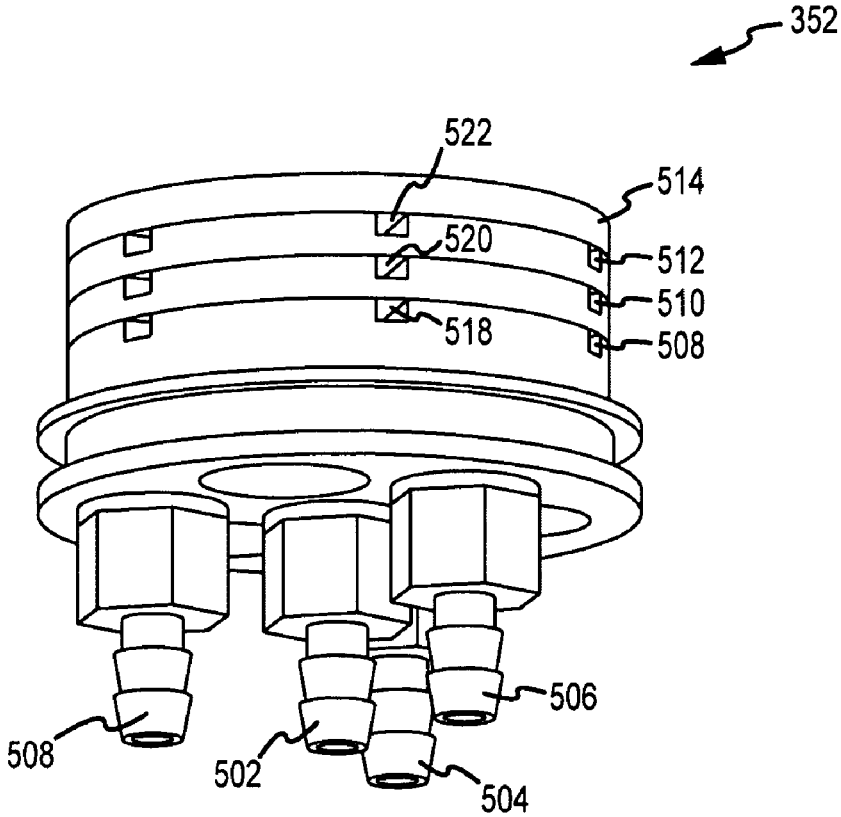
FIG. 5 is a perspective view of an exemplary plug capable of supplying slurry to multiple delivery zones.

Turning now to FIG. 5, an exemplary plug suitable for use as a fluid source 352 in platen 112 (FIG. 3) is shown. Plug 352 suitably receives fluid via any number of fittings 502, 504, 506, 508, with each fitting providing fluid to one or more fluid distributing sections 508, 510, 512. In various embodiments, each section 508, 510, 512 includes internal channeling that interconnects one of the fittings 502-508 with one or more orifices 518, 520, 522 that act as a fluid source to the distribution channels (e.g. channels 312, 322, 332 in FIG. 3) associated with each fluid distribution layer 310, 320, 330 as appropriate.

In the embodiment shown in FIG. 5, each fitting 502-508 is an independent fitting capable of receiving a supply line or other connection to a fluid supply. By controlling the amount of supplied fluid and/or the flow rate of the fluid provided in the supply line, the amount of fluid ultimately provided to each zone 115-118 (FIG. 1) can be controlled as desired. Each fitting 502-508 may designed in any convenient manner, and using any appropriate material (e.g., aluminum, titanium or another metal). In various embodiments, each fitting 502-508 includes a barbed end for receiving a tube or other fluid distribution line, as well as an opposing tapered or other appropriately-shaped end that can be inserted into plug 352 as desired. In various embodiments, each fitting 502-508 is joined to the plug assembly 352 via a bushing or other receiving member, as described more fully below. Alternatively, each fitting 502-508 may be molded or otherwise integrally formed with plug 352 in any manner.

Sections 508, 510, 512 may be similarly formed in any manner, using any convenient materials. In various embodiments, sections 508, 510, 512 are molded or otherwise formed from aluminum, titanium or another metal, although other materials such as plastic, ceramic, carbon fiber and/or the like could be equivalently used. The multiple sections are designed so that the orifices 518, 520, 522 align with the corresponding distribution channels 312, 322, 332 as appropriate. Note that, while FIG. 5 shows plug 352 as being round, alternate embodiments could take any other shape or dimension. The various sections 508, 510, 512 may be joined to each other and/or to fittings 502-508 in any manner, such as with any sort of adhesive or other bond.

Figure 6:
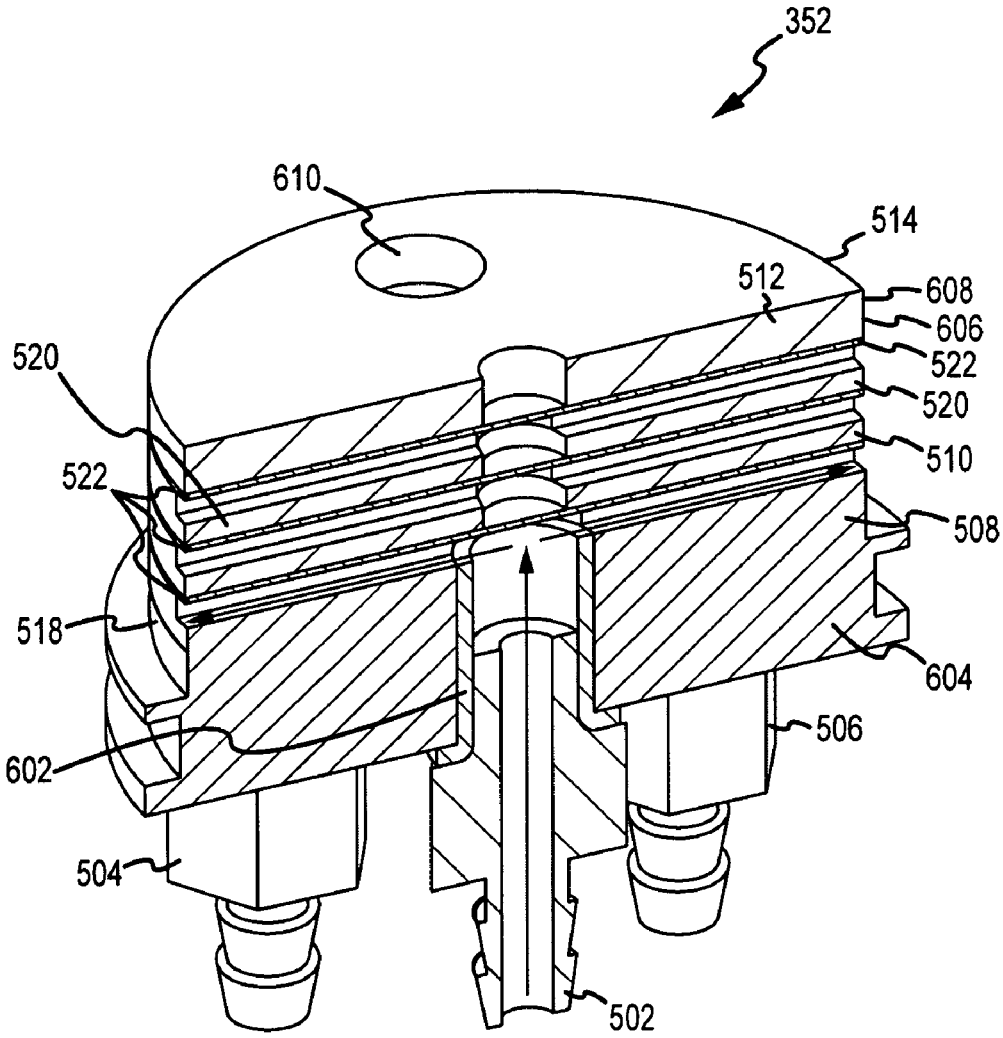
FIG. 6 is a cutaway view of an exemplary plug capable of supplying slurry to multiple delivery zones.

FIG. 6 shows a cutaway view of plug 352 with additional detail about internal fluid distribution features. With reference now to FIG. 6, each section 508, 510, 512 is shown with a channel 604, 606, 608 (respectively) that extends from the fluid-delivering fitting (e.g., fitting 602) to the orifices 518, 520, 522 on the outer surface of plug 352. In the cutaway view of FIG. 6, fluid delivered to a particular zone (e.g., any of zones 115-118) is delivered through fitting 502 to channel 604, which in turn connects to orifices 518 on the outer face of plug 352. Channels 606 and 608 similarly extend from fittings 504 and/or 506 toward orifices 520 and 522, respectively. FIG. 6 also shows an optional bushing 602 that facilitates insertion and coupling of fitting 502 into plug 352. In various embodiments, the various sections 508, 510, 512 are joined together using any suitable adhesive (e.g., an adhesive that prevents leaking of fluid from channels 604, 606, 608), such as any sort of polymer adhesive or the like. Plug 352 may also be shaped with one or more through-holes (e.g., hole 610) that extend longitudinally through the plug 352 to allow for a bolt, screw or other affixing member to connect plug 352 into platen assembly 112 (FIG. 3) as appropriate.

Figure 7:
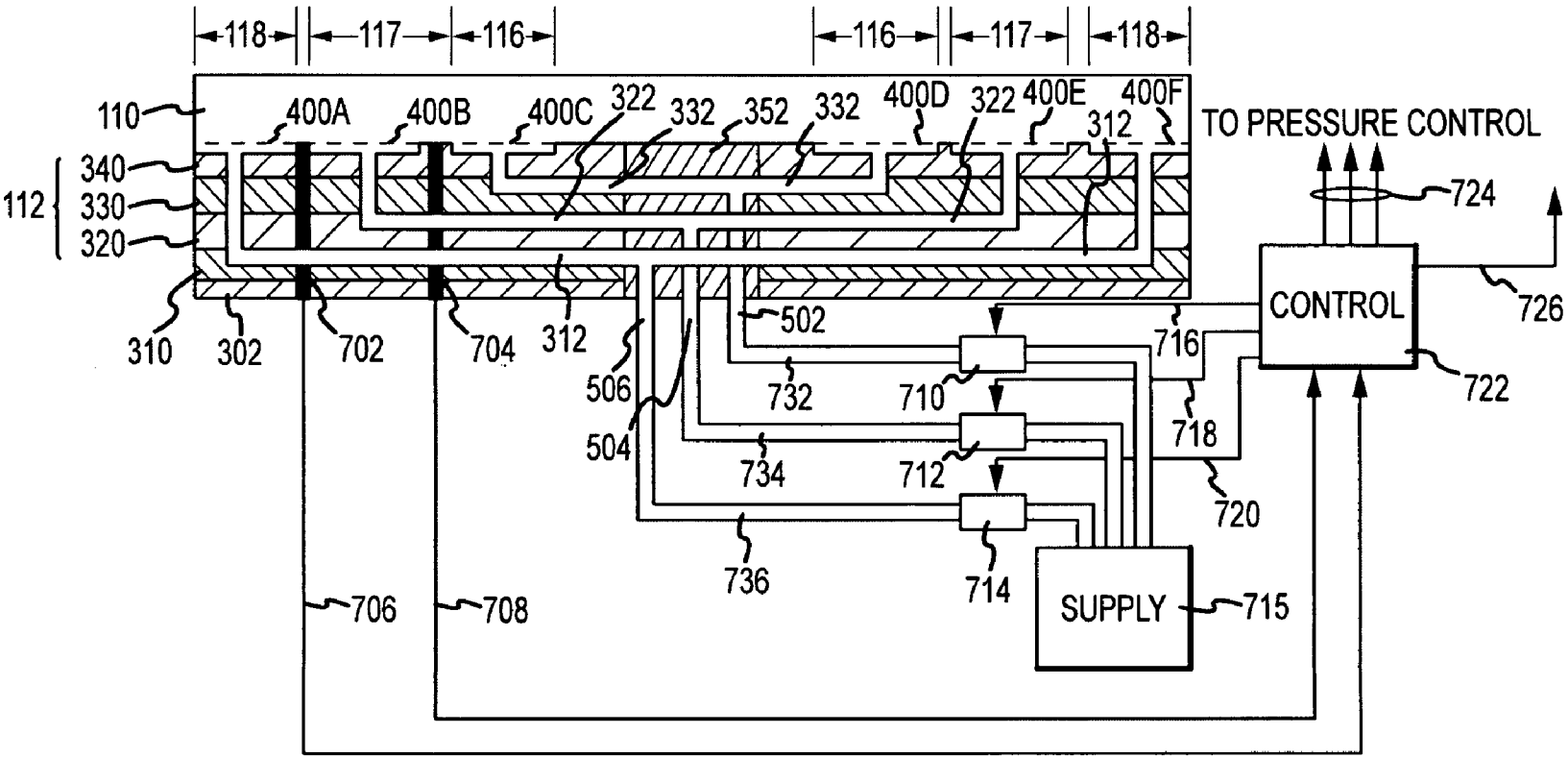
FIG. 7 is a side block diagram of an exemplary control and delivery system showing slurry delivery to multiple zones of a polishing pad.

In operation, then, slurry or other fluid can be provided across a polishing surface of pad 110 to a number of fluid-delivery zones 115-118 in any manner. As shown in the exemplary embodiment illustrated in FIG. 7, fluid is provided from a tank or other supply 715 to polishing pad 110 via any number of valves or other fluid controls 710, 712, 714 leading to supply lines 732, 734, 736, respectively. These supply lines 732, 734, 736 connect to fittings 502, 504, 506 in plug 352, which in turn provide fluid to channels 332, 322, 312 (respectively) of distribution layers 310, 320, 330. Fluid then passes through channel holes in the various distribution layers 320, 330 to expansion layer 340, where various expansion structures 400A-F increase the coverage area of each zone. In the exemplary embodiment shown in FIG. 7, fluid provided by supply line 732 ultimately supplies zone 1168 on polishing pad 110. Fluid from supply lines 734 and 736 similarly supply zones 117 and 118, respectively.

By adjusting the amount of fluid flow (or, equivalently, the rate of fluid flow) in supply lines 732, 734, 736, then, the amount of fluid distributed to each zone 116, 117, 118 can be independently adjusted. One technique for controlling fluid control involves the use of a digital controller 722, which is any microprocessor, microcontroller, programmable logic and/or other control device as appropriate. In various embodiments, controller 722 includes (or communicates with) a digital memory, input/output and the like to implement any suitable control scheme for polishing/planarizing a wafer or other work piece 108 (FIG. 1) in any desired manner. In particular, controller 722 may contain input/output pins or the like that are capable of providing control signals 716, 718, 720 to fluid controls 710, 712, 714, respectively. In various embodiments, control signals 716, 718, 720 are simply digital or analog signals that can be used to control the rate of fluid flow in supply lines 732, 734, 736, respectively. In one embodiment, fluid controllers 710, 712, 714 are digitally-controlled valves that open and close in response to a received digital signal (e.g., signals 716, 718, 720). By controlling the duty cycles of the applied signals, then (e.g., in a manner similar to pulse coded modulation (PCM)), the rate of fluid flow allowed by the valve can be controlled. A sixty-percent duty cycle on a signal 716, for example, could result in valve 710 remaining open for 60% of any particular period of time. The particular time could be any time period ranging from fractions of seconds to several seconds, although other embodiments may vary from these parameters. Increasing or decreasing the duty cycle of signal 716 would have the effect of increasing or decreasing the rate of fluid flow through supply line 732. Fluid flow rates through supply lines 734, 736 could be equivalently adjusted by adjusting the duty cycle (or other characteristics) of signals 718, 720, respectively.

In various embodiments, one or more eddy current probes 702 and/or endpoint detection probes 704 may also be present within platen assembly 112. In such embodiments, each probe 702, 704 typically provides a data reporting signal 706, 708 (respectively) to controller 722. Such information may be used in any manner; data 706 received from one or more eddy current probes 704, for example, may be used to adjust the amount of fluid provided to one or more zones 116-118. Such adjustments may be used, for example, to increase or decrease the shear friction in any portion of the pad, to reduce hydroplane effects, and/or for any other purposes. Optical or other endpoint detectors 704 may also be provided to generate data 708 that can assist controller 722 in determining when polishing/planarization is complete, or to identify non-uniformities across the surface of work piece 108. Probes 702 and 704 may be installed within platen 112 in any conventional manner; in various embodiments, the various layers 302, 310, 320, 330, 340 may include holes or other recesses to accommodate probes 702, 704 of any size. In some embodiments, a probe bushing may also be provided to mate with the platen assembly 112 as appropriate.

Controller 722 therefore controls the flow of fluid from supply 715 to pad 110 in any manner. In various embodiments, controller adjusts the amount of fluid provided to zones 116, 117, 118 as appropriate to produce desired results during polishing/planarization. Controller 722 may also provide one or more control signals 724 that can be used to adjust the pressure applied to pad 110, or to any portion of pad 110. In various embodiments, pressure applied to each zone 116-118 can be coordinated with the amount of fluid provided to the zone 116-118. Pressure may be applied from either side of work piece 108 (e.g., by carrier head 106 and/or by platen 112) in embodiments that provide such features. Controller 722 may also provide an output signal 726 to a system controller or output device, as appropriate.

Figure 8:
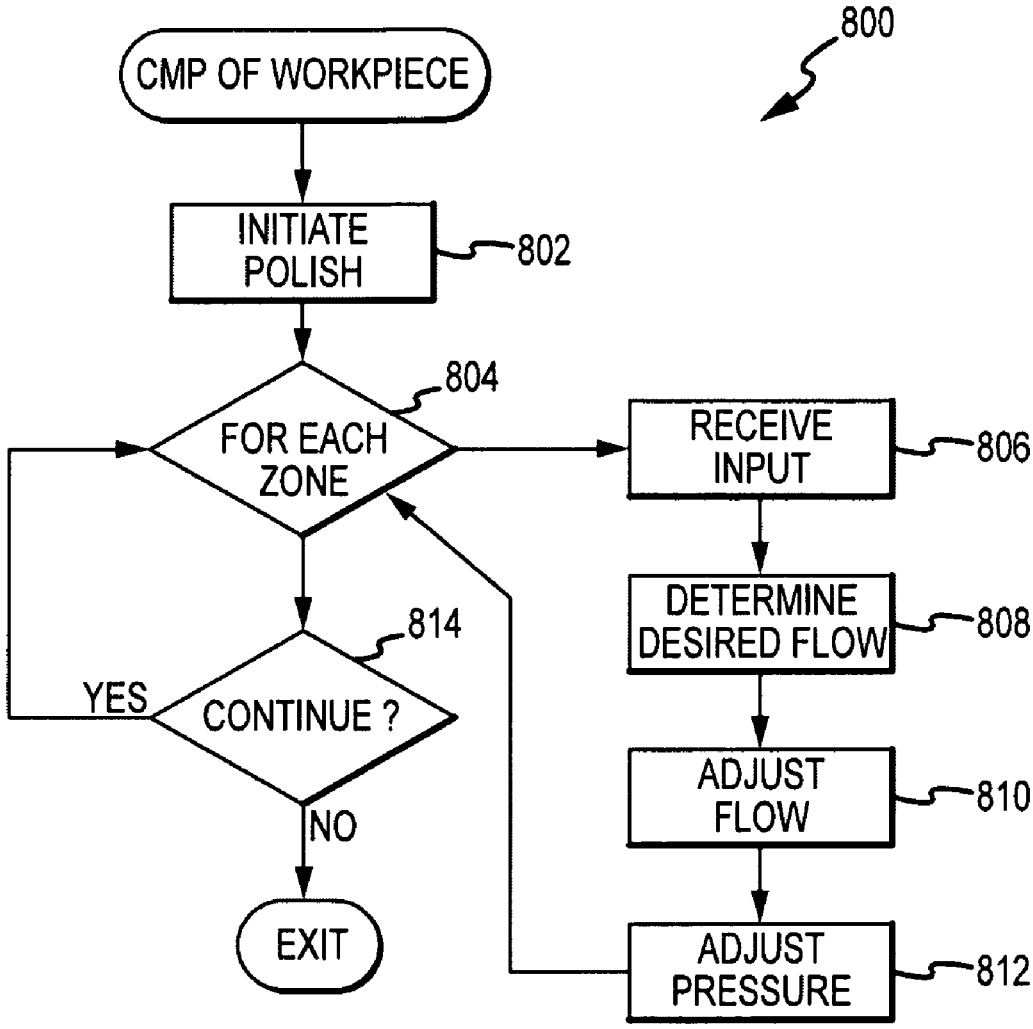
FIG. 8 is a flowchart of an exemplary process for polishing a work piece using a multi-zone CMP apparatus.

With final reference now to FIG. 8, an exemplary process 800 for performing chemical-mechanical polishing/planarization on a workpiece 108 (FIG. 1) suitably includes the broad steps of initiating chemical-mechanical polishing of the work piece to thereby provide fluid to the work piece via each of the fluid delivery zones (step 802), and, for each of the fluid delivery zones, adjusting an amount of fluid provided via the delivery zone (step 810). Process 800 may be executed in any manner. In various embodiments, the various steps of process 800 are implemented in computer-executable instructions residing in a memory or other storage medium and executing on a digital computer system (such as controller 722 in FIG. 7). The various process steps shown in FIG. 8 are simply logical steps that may be executed as part of one exemplary process; in practice, the steps may be differently organized, differently ordered, supplemented or otherwise modified in any manner. In particular, it is not necessary that the various process steps be executed in the temporal order shown in FIG. 8.

Initiation of chemical-mechanical polishing/planarization takes place in any manner (step 802). In various embodiments, slurry or other fluid is initially delivered to each of the various zones 115-118 (FIG. 1) on pad 110, and relative motion of workpiece 108 and/or pad 110 is initiated in any orbital, rotational and/or other manner. During polishing, the amount of fluid provided to each of the various zones 115-118 (step 804) can be adjusted in any manner. In the exemplary embodiment of FIG. 8, fluid flow is adjusted (step 810) for each zone based upon received and/or computed data. Step 806, for example, reflects that data may be received from any sort of probe (e.g., probes 702, 704 in FIG. 7), and that this data (e.g., data 706, 708) may be processed in any manner. If significant eddy currents are observed in a particular region of pad 110, for example, fluid provided to that region may be reduced (or otherwise adjusted) until the currents are reduced.

The particular amounts or rates of fluid flow may be calculated or otherwise applied in any manner (step 808). In various embodiments, a nominal flow rate is set at the outset of polishing, with flow adjusted upwardly or downwardly as appropriate. The flow rate may be represented and established in any manner. In an exemplary embodiment, a desired flow rate is mathematically computed using conventional data processing techniques, and the resulting values are then converted to appropriate representations that can be applied as control signals 716, 718, 720 (FIG. 7) or the like that can perform the actual adjustment of fluid flow (step 810). The PCM technique described above, for example, could be used to open and close a conventional digital valve and thereby adjust the rate of fluid flow provided to any particular zone 115-118 of polishing pad 110. Other encoding and implementation schemes could be formulated in any number of alternate embodiments.

As noted above, the pressure applied to one or more zones 115-118 (or to the entire pad 110) may be adjusted in any manner (step 812). In various embodiments, pressure can be applied independently to each of the controllable zones 115-118, so each zone 115-118 may have an applied pressure that is controlled in conjunction with the supplied fluid. The pressure and fluid flow may be correlated in any manner; fluid flow may be increased as pressure is increased, for example, or otherwise adjusted as appropriate.

In summary, new systems, apparatus and methods for performing chemical-mechanical polishing/planarization have been provided. By providing a number of fluid-delivery zones that can each be independently controlled, improved surface uniformity can be obtained, and/or additional performance enhancements can be provided.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A chemical-mechanical polishing apparatus for polishing a workpiece, the apparatus comprising:
- a polishing pad having a polishing surface configured to engage the workpiece, wherein the polishing pad comprises a plurality of fluid delivery zones including a first fluid delivery zone and a second fluid delivery zone; and
- a platen mechanically supporting the polishing pad from a side of the polishing pad opposite the polishing surface and providing fluid to each of the fluid delivery zones, wherein the platen comprises a common fluid source and a plurality of fluid distribution layers each arranged in parallel with the other fluid distribution layers and with the polishing pad, wherein the plurality of fluid distribution layers comprises:
  - a first fluid-distribution layer having a first fluid-distributing channel extending from the common fluid source to a first distribution point on the first fluid distribution layer that corresponds to the first fluid-delivery zone on the polishing pad; and
  - a second fluid-distribution layer located between the first fluid-distribution layer and the polishing pad, the second fluid-distribution layer having a second fluid-distributing channel extending from the common fluid source to a second distribution point on the second fluid distribution layer that corresponds to the second fluid delivery zone on the polishing pad that is different from the first fluid delivery zone, and wherein the second layer comprises at least one hole that allows fluid from the first distribution point on the first fluid-distribution layer to pass through the second fluid-distribution layer toward the first fluid delivery zone on the polishing pad.

2. The apparatus of claim 1 wherein the first and second fluid distribution layers are stacked with each other.

3. The apparatus of claim 1 further comprising a third fluid-distribution layer interposing the first and second fluid-distributing layers, wherein the third fluid-distribution layer has a third fluid-distributing channel extending from the common fluid source to a third distribution point on the third fluid distribution layer that corresponds to a third fluid delivery zone on the polishing pad that is different from the first and second fluid delivery zones, and wherein the third layer comprises a first hole that allows fluid from the first distribution point on the first fluid-distribution layer to pass through the third fluid-distribution layer toward the hole in the second fluid distribution layer toward the first fluid delivery zone on the polishing pad, and wherein the second layer comprises a second hole that allows fluid from the third distribution point on the third fluid distribution layer to pass through the second fluid-distribution layer toward the third distribution point on the polishing pad.

4. The apparatus of claim 1 wherein the common fluid source comprises a plug configured to be inserted into the platen.

5. The apparatus of claim 4 wherein the plug comprises a plurality of fluid distributing sections, wherein each of the plurality of sections comprises an orifice corresponding to the fluid-distributing channel of one of the fluid distribution layers.

6. The apparatus of claim 5 wherein each of the fluid distributing sections comprise an internal channel in fluid communication with the orifice.

7. The apparatus of claim 5 wherein the plug further comprises a plurality of fittings, each fitting having a central channel coupling the internal channel of one of the fluid distributing sections to one of a plurality of fluid delivery lines.

8. The apparatus of claim 7 further comprising a controller configured to adjust the fluid flow provided by each of the plurality of fluid delivery lines.

9. The apparatus of claim 1 wherein the platen further comprises an expansion layer displaced between the plurality of fluid-distribution layers and the polishing pad, wherein the expansion layer comprises a plurality of channel holes each corresponding to one of the distribution points of the fluid-distribution layers.

10. The apparatus of claim 8 wherein the expansion layer further comprises a plurality of expansion channels extending radially outward from each of the channel holes.

11. A platen for use in a chemical-mechanical polisher that polishes a work piece using a polishing pad having a plurality of fluid delivery zones including a first fluid delivery zone and a second fluid delivery zone, the platen comprising:

a first fluid distribution layer comprising a first channel radially extending from a first fluid source to a first distribution point corresponding to the first fluid delivery zone on the polishing pad;

a second fluid distribution layer proximate the first fluid distribution layer and configured to be located between the first fluid distribution layer and the polishing pad during operation, wherein the second fluid distribution layer comprises a second channel radially extending from a second fluid source to a second fluid distribution point that corresponds to the second fluid delivery zone on the polishing pad, wherein the second fluid distribution layer further comprises a hole configured to receive fluid from the first distribution point in the first fluid distribution layer; and an expansion layer proximate the second fluid distribution layer and configured to be located between the second fluid distribution layer and the polishing pad on a side of the second fluid distribution layer opposite the first distribution layer, wherein the expansion layer comprises a first channel hole corresponding to the hole in the second fluid distribution layer and a second channel hole corresponding to the second fluid distribution point to thereby receive fluid provided by the first and second fluid distribution layers, respectively, and to distribute fluid to the first and second fluid delivery zones of the polishing pad, respectively, during operation of the platen.

12. The platen of claim 11, wherein the first and second fluid distribution layers are adapted to receive a plug that provides the first and second fluid sources.

13. The platen of claim 12 wherein the plug comprises a first layer configured to transmit fluid from a first fitting to the first fluid source and a second layer configured to transmit fluid from a second fitting to the second fluid source.

14. The platen of claim 11 wherein the expansion layer further comprises a plurality of expansion channels extending radially outward from each of the first and second channel holes.

15. A method of chemical-mechanical polishing of a work piece, the method comprising:

initiating chemical-mechanical polishing of the work piece using a chemical mechanical polisher comprising a polishing pad and a platen, wherein the polishing pad comprises a plurality of fluid delivery zones and the platen comprises a plurality of fluid distribution layers comprising at least a first fluid distribution layer and a second fluid distribution layer, wherein the second fluid distribution layer is located proximate the first delivery layer between the first fluid distribution layer and the polishing pad, wherein the first fluid distribution layer delivers fluid to a first one of the fluid delivery zones on the polishing pad and the second fluid distribution layer delivers fluid to a second one of the fluid delivery zones of the polishing pad, and wherein the second fluid distribution layer has a hole that allows fluid from the first distribution layer to flow through the second fluid distribution layer toward the first fluid delivery zone of the polishing pad;

providing fluid to the work piece via each of the plurality of fluid distribution layers from a common fluid source; and for each of the plurality of fluid delivery zones, adjusting an amount of fluid provided to the fluid delivery zone by controlling the amount of fluid that is provided from the common fluid source to the layer of the platen that is associated with the fluid delivery zone, wherein the adjusting takes place during chemical-mechanical polishing of the work piece.

16. The method of claim 15 wherein the amount of fluid provided to each of the plurality of zones is adjusted independently of the amount of fluid provided to the other zones.

17. The method of claim 15 further comprising deactivating fluid delivery in at least one of the fluid delivery zones while continuing fluid delivery in at least another one of the fluid delivery zones.

18. The method of claim 15 wherein the amount of fluid provided via at least one of the plurality of zones is adjusted in response to data received from a probe.

19. The method of claim 15 wherein the amount of fluid provided via at least one of the plurality of zones is adjusted in conjunction with an applied pressure.

20. The method of claim 15 further comprising adjusting a pressure applied to at least one of the plurality of fluid delivery zones during chemical-mechanical polishing of the work piece.

* * * * *